US005492199A

United States Patent [19]

Shimoyama

[11] Patent Number: 5,492,199

[45] Date of Patent: Feb. 20, 1996

[54] CHECKOUT DEVICE

[75] Inventor: Hiroyuki Shimoyama, Shizuoka, Japan

[73] Assignee: TEC Corporation, Shizuoka, Japan

[21] Appl. No.: 376,871

[22] Filed: Jan. 23, 1995

[30] Foreign Application Priority Data

Jan. 21, 1994 [JP] Japan ..... 6-005419

[51] Int. Cl.[6] ..... A47F 9/04

[52] U.S. Cl. ..... 186/61; 235/383

[58] Field of Search ..... 186/52, 59, 60, 186/61, 66, 68; 235/383

[56] References Cited

U.S. PATENT DOCUMENTS

| | | | |
|---|---|---|---|
| 3,186,515 | 6/1965 | Potrafke | 186/59 |
| 4,792,018 | 12/1988 | Humble et al. | 186/61 |
| 5,178,234 | 1/1993 | Sakurai et al. | 186/68 X |
| 5,311,969 | 5/1994 | Dickover et al. | 186/61 |
| 5,316,107 | 5/1994 | Wieschemann et al. | 186/61 |
| 5,343,025 | 8/1994 | Usui | 235/383 |
| 5,375,680 | 12/1994 | Ikeda et al. | 186/61 |
| 5,412,193 | 5/1995 | Swartz et al. | 235/383 |

FOREIGN PATENT DOCUMENTS

| | | | |
|---|---|---|---|
| 0531265 | 3/1993 | European Pat. Off. | 186/61 |
| 0585732 | 3/1994 | European Pat. Off. | 186/61 |

*Primary Examiner*—Michael S. Huppert
*Assistant Examiner*—Scott L. Lowe
*Attorney, Agent, or Firm*—Frishauf, Holtz, Goodman, Langer & Chick

[57] ABSTRACT

A checkout device includes first and second stationary scanners forming central portions of first and second scanning lanes set in parallel with each other, each for reading an article code affixed to an article which is moved from an upstream side to a down stream side in a corresponding scanning lane, and a settlement section arranged between the first and second scanning lanes for performing a settlement process based on article codes sequentially supplied from each of the stationary scanners. In particular, the checkout device further includes a position adjusting mechanism for variably setting a position of the settlement section along the first and second scanning lanes.

12 Claims, 7 Drawing Sheets

CHECKOUT DEVICE

BACKGROUND OF THE INVENTION

1. Field of the Invention

The present invention relates to a checkout device in which sales transactions for two customers can be effected in parallel.

2. Description of the Related Art

In recent years, a large number of large-scale stores such as supermarkets introduced various types of checkout devices for speeding up the checkout.

FIG. 1 shows a conventional checkout device. The checkout device has two scanning lanes L1 and L2 which are symmetrically disposed with respect to the position of a cashier CHR. Each of the scanning lanes L1 and L2 has two tables TB1 and TB2 on which a basket BS is placed, and a stationary scanner SC disposed between the tables TB1 and TB2. Further, the checkout device has two electronic cash registers CR assigned to and installed between the scanning lanes L1 and L2. The scanner SC optically scans and reads an article code affixed to an article in the form of a bar code, and has a switching section SW for instructing start and end of scanning. The cash register CR performs a settlement process based on article codes read by the scanner SC.

A customer CST selects one of the scanning lanes L1 and L2, for example, the scanning lane L1, places the basket BS containing articles to be purchased on the table TB1 on the scanning lane L1 side, and operates the switching section SW to instruct the scanner SC to start scanning. After this, the customer CST takes out the articles one by one from the basket BS, causes the scanner SC to read the article code of the article, and puts the article into another basket BS which is previously placed on the table TB2 and is first empty. After the article codes of all of the articles are input by use of the scanner SC, the customer CST operates the switching section SW to instruct the scanner SC to end the scanning. The cash register CR on the scanning lane L1 side registers article data (an article name, a unit price, and the like) corresponding to each of the article codes sequentially supplied from the scanner SC as sales data, causes the sales data to be displayed on the cashier display unit DP1 and customer display unit DP2, totalizes all of the sales data items according to the operation of the keyboard KB, and issues a receipt on which the result of totalization containing article names, unit prices, the number of articles, and the total amount is printed by the printer PR. As regards the foregoing articles whose article codes are difficult to be input by use of the scanner SC, the cashier CHR receives these articles from the customer CST and enters their article codes by using the keyboard KB, for example.

In the checkout device, the customer inputs the article codes instead of the cashier. Though the cashier has to monitor the customers who input the article codes on the scanning lanes L1 and L2 and carry out an operation of the cash register CR necessary for receiving cash from or giving cash to the customer, it is hardly a burden to the cashier. Further, time for the customer to look on the operation of the cashier without doing anything can be shortened by time corresponding to the input operation carried out by the customer. Therefore, a good impression can be given to the customer. In addition, since one cashier is in charge of two scanning lanes L1 and L2, the labor cost can be reduced.

Nevertheless, the above checkout device is not widespread due to the following drawback. That is, in supermarkets, the time band of congestion periodically changes depending on the month, week, and day, for example. If article codes are input by a customer who is not familiar with the checkout device, a delay will easily occur in the input operation. This makes the time for waiting customers' turn for the checkout to be lengthened at the time of congestion. Further, both the scanning lanes L1 and L2 will be occupied to input article codes at the time of congestion. If the cashier is dealing with a customer who has finished scanning article codes of articles on one scanning lane, then he or she cannot monitor another customer who inputs article codes of articles on the other scanning lane. It is therefore impossible to prevent dishonesty in which some articles are put in the basket BS on the table TB2 without reading their code.

SUMMARY OF THE INVENTION

An object of the present invention is to provide a checkout device in which quick and smooth checkout is not impaired due to an increase in the number of 10 customers waiting their turn for checkout.

The above object can be attained by a checkout device comprising first and second stationary scanners forming central portions of first and second scanning lanes set in parallel with each other, each for reading an article code affixed to an article which is moved from an upstream side to a down stream side in a corresponding scanning lane; and a settlement section arranged between the first and second scanning lanes for performing a settlement process based on article codes sequentially supplied from each of the stationary scanners; and a position adjusting mechanism for variably setting a position of the settlement section along the first and second scanning lanes.

According to the foregoing checkout device, the position adjusting mechanism variably sets a position of the settlement section along the first and second scanning lanes. In a case where the settlement section is set at a reference position where it is on a line connecting the first and second stationary scanners, one operator stands in front of the settlement section to operate it. In this case, the operator can watch each of two customers who operate the first and second stationary scanners to input article codes. In a case where the settlement section is set on the upstream side of the reference position, two operators stand in front of the settlement section between the first and second stationary scanners to operate the settlement section and the first and second scanners. In this case, article codes are input by the two operators, it is possible to eliminate a delay caused when article codes are input by a customer who is not familiar with the checkout device. In a case where the settlement section is set on the down stream side of the reference position, two operators stand behind the settlement section between the first and second stationary scanners to operate first and second stationary scanners and another operator stands in front of the settlement section to operate the settlement section. In this case, the stationary scanners and settlement section are operated by different operators. Therefore, the checkout speed can be enhanced. Consequently, in the aforementioned checkout device, layout of operators can be optimized by varying the position of the settlement section according to changes in the number of customers waiting their turn for checkout. Therefore, quick and smooth checkout is not impaired due to an increase in the number of customers. Further, the checkout device can cope with an increase in the number of customers within a limited space. In addition, since the number of operators can be increased in proportion to the number of customers, mental and physical burdens to the operators can be prevented from excessively increasing.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE PREFERRED EMBODIMENT

There will now be described a checkout device according to an embodiment of the present invention with reference to the accompanying drawings.

Figure 1:
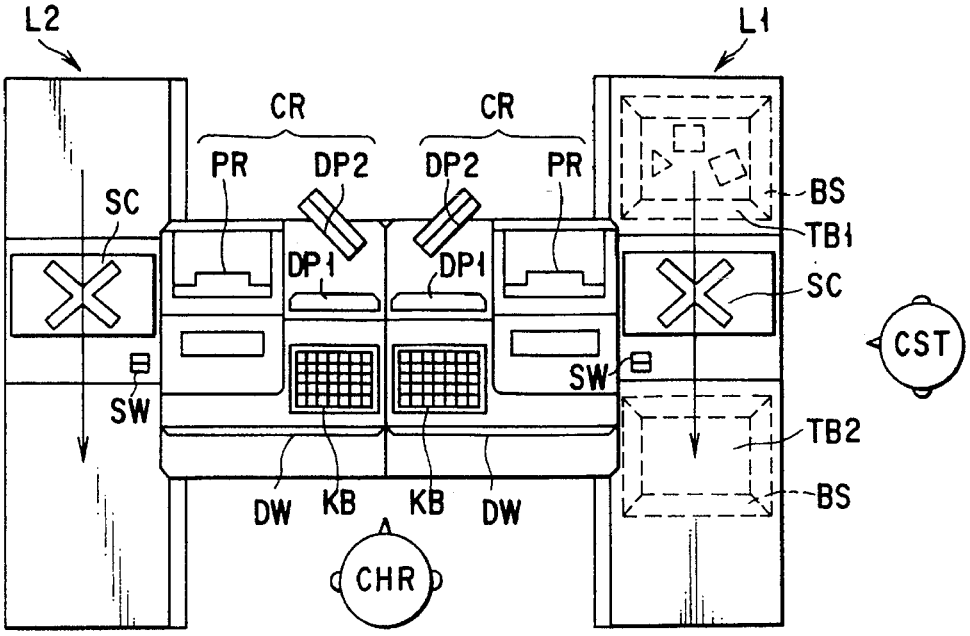
FIG. 1 (PRIOR ART)
FIG. 1 is a plan view showing a conventional checkout device to which article codes are input by customers.
Figure 2:
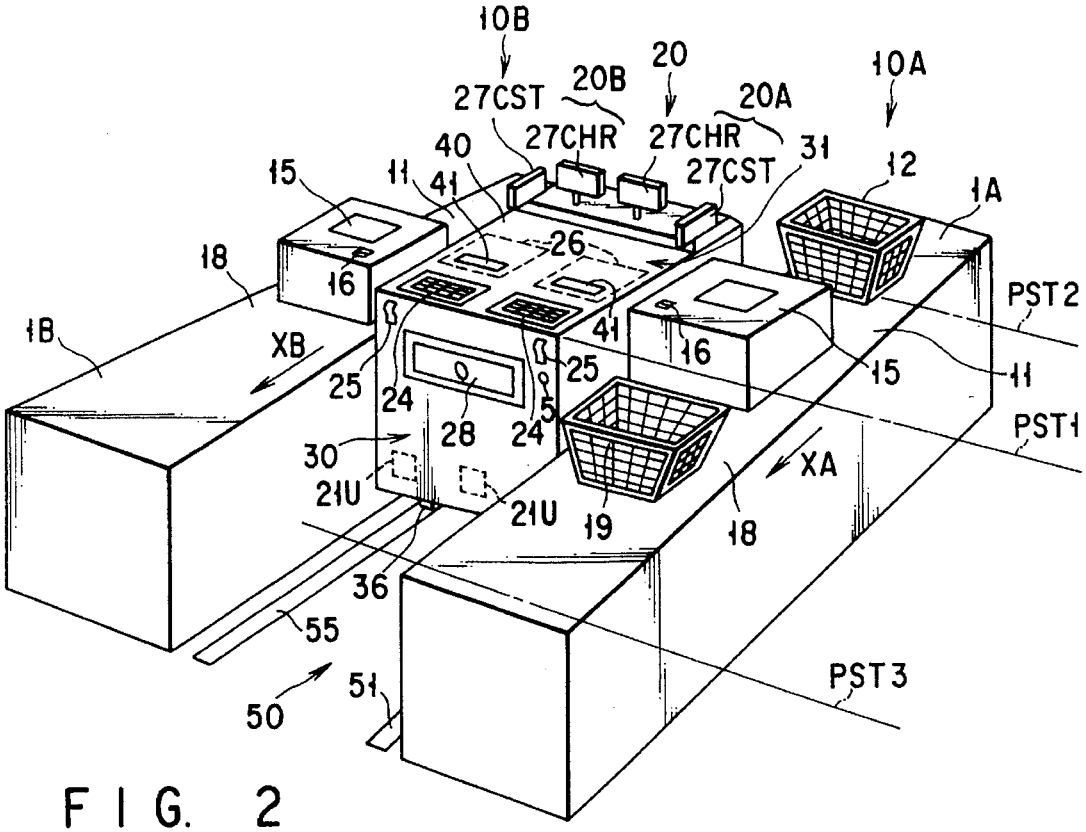
FIG. 2 is a perspective view showing a checkout device according to an embodiment of the present invention.

The checkout device is shown in FIG. 2 and includes two scanning lanes 10A and 10B arranged in parallel to each other and a settlement section 20 disposed between the scanning lanes 10A and 10B.

Each of the scanning lanes 10A and 10B has a carry-in table 11, stationary scanner 15, and carry-out table 18 disposed on a row. The carry-in table 11 is a table on which a basket 12 containing articles to be purchased by a customer is placed. The stationary scanner 15 is operated to input article codes affixed in the bar code form to the articles contained in the basket 12. The articles sequentially taken out from the basket 12 are optically scanned to read their codes. The carry-out table 18 is a table on which another basket 19 is placed to receive articles whose article codes have been read by the stationary scanner 15. The stationary scanner 15 is disposed between the carry-in table 11 and the carry-out table 18 and has a switching section 16 including instruction keys such as a scanning start key and a scanning end key. The carry-in table 11 and carry-out table 18 can be one component using a sacker table 1A (1B).

The settlement section 20 includes electronic cash registers 20A and 20B which are respectively assigned to the scanning lanes 10A and 10B, a housing 30 for unifying the cash registers 20A and 20B, and a drawer 28 common to the electronic cash registers 20A and 20B. Each of the electronic cash registers 20A and 20B includes a control section 21U, keyboard 24, handy scanner 25, printer 26, cashier display unit 27CHR, customer display unit 27CST, mode switch 5, receipt issuing port 41, and article table 40. The width of the settlement section 20 is set to be as small as possible within an extent that two operators (cashiers) do not feel cramped to operate the settlement section 20. The distance between the scanning lanes 10A and 10B is set to be slightly larger than the width of the settlement section 20.

In each of the electronic cash registers 20A and 20B, the control section 21U includes a CPU, ROM and RAM, and performs various mode processes including a settlement process for sequentially registering items of article data (article names, unit prices, and the like) corresponding to article codes sequentially supplied from the stationary scanner 15 on the side of the corresponding scanning lane 10A (10B) as sales data items and totalizing all of the registered sales data items. The keyboard 24 is operated by the cashier CHR to input article codes and control instructions necessary for the settlement process. The keyboard 24 includes a Tendered/Amount Total key for instructing execution of the account totalization, a plurality of PLU keys for selecting articles such as articles for special sale and vegetables and numerals keys for inputting article codes of various articles. The handy scanner 25 is operated by the cashier CHR to selectively read one of the article codes printed on a bar code table sheet in the bar code form for articles such as vegetables and articles for special sale. The printer 26 is used to print the result of totalization obtained for all of the registered sales data items on receipt paper. The cashier display unit 27CHR and customer display unit 27CST are rotatable so as to face the positions of the cashier CHR and the customer CST-A (CST-B) and display each of the registered sales data items. The mode switch 5 is used to select a process mode of the control section 21U according to the position of the inserted key. The article table 40 is exposed in a portion between the display units 27CHR, 27CST and the keyboard 24, constructs a lid plate of the housing 30, and is used to temporarily hold an article whose article code is difficult to read by use of the scanner 15 on the corresponding scanning lane 10A (10B) side. The article table 40 is set at substantially the same height as the scanner 15. The drawer 28 is caused to slide towards the cashier CHR side by the control of each of the control sections 21U of the cash registers 20A and 20B so as to be set into an open state and receive cash which the cashier puts into the drawer. The receipt issuing port 41 is an opening formed in part of the article table 40 and permits a receipt supplied from a receipt discharging port 26R of the printer 26 to pass therethrough when the printer 26 is set in the housing 30 and guides the receipt to the cashier CHR side.

Figure 3:
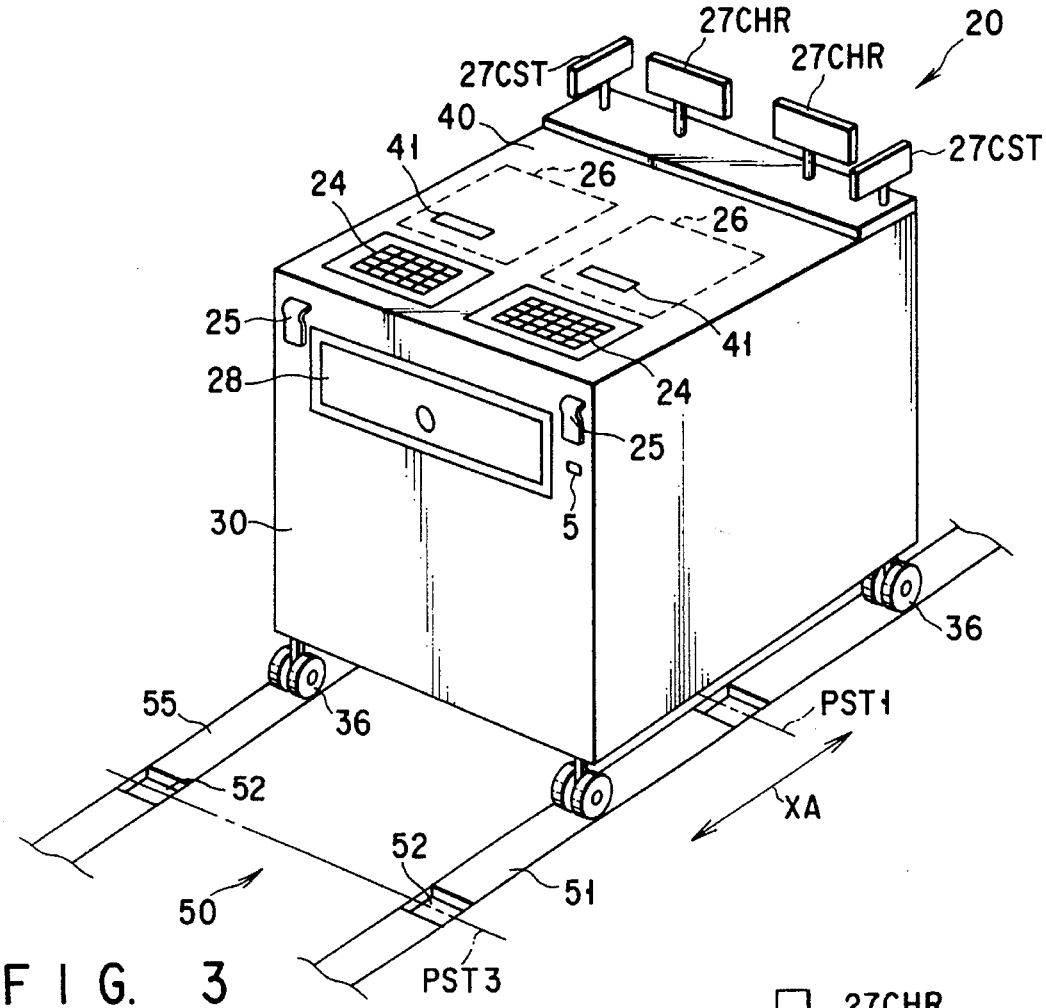
FIG. 3 is a perspective view showing a settlement section and position adjusting mechanism shown in FIG. 2.
Figure 4:
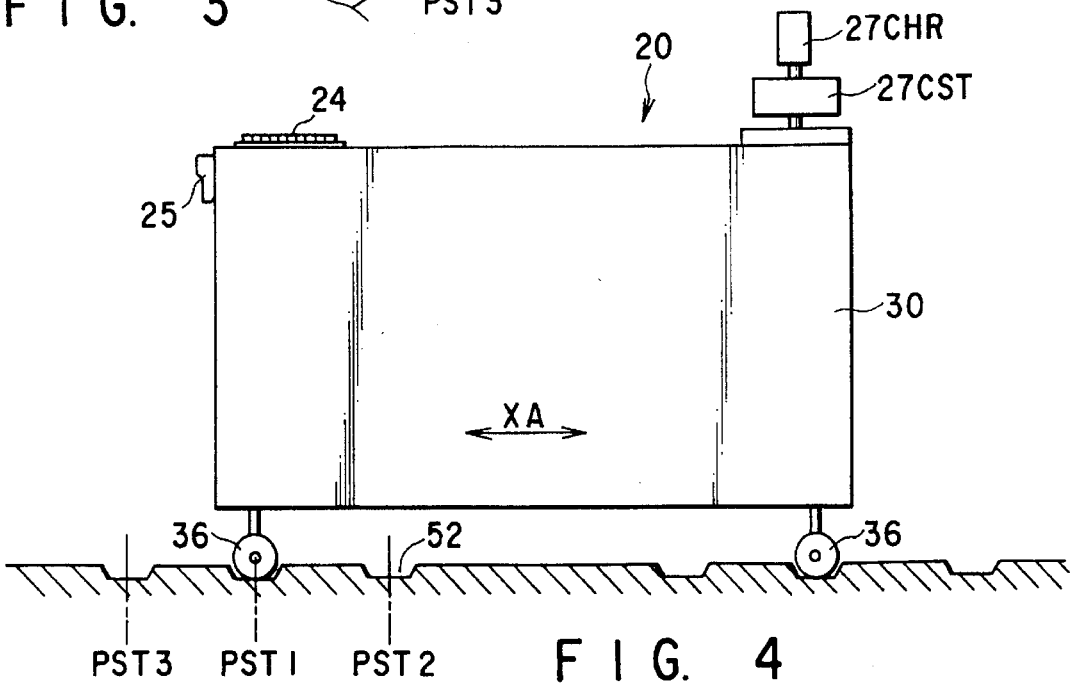
FIG. 4 is a view showing positions where the settlement section is variably set by means of the position adjusting mechanism shown in FIG. 3.

The checkout device further includes a position 10 adjusting mechanism 50 for variably setting the position of the settlement section 20 along the scanning lanes 10A and 10B. As shown in FIGS. 2 and 3, the position adjusting mechanism 50 is composed of two rails 51 and 55 mounted on the floor between the scanning lanes 10A and 10B and set in parallel to each other, and four casters 36 fixed to the bottom of the housing 30 of the settlement section 20 and movable on the rails 51 and 55. The rails 51 and 55 has plural groups of recesses 52 shown in FIGS. 3 and 4. The settlement section 20 is set or fixed at one of three positions PST1, PST2, and PST3 when the casters 52 are received in a corresponding group of the recesses 52.

Figure 5:
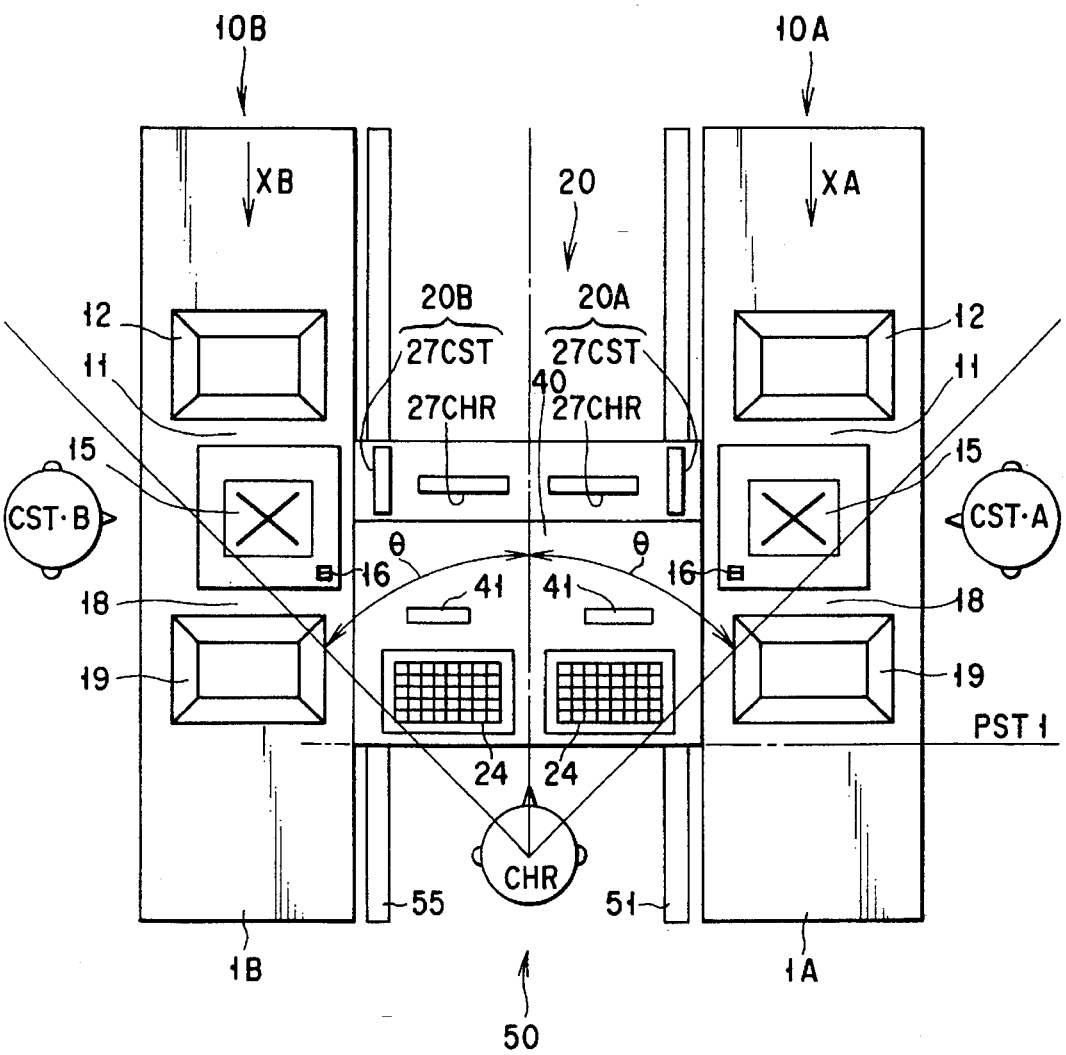
FIG. 5 is a plan view showing the checkout device wherein the settlement section is set at a first position shown in FIG. 4.

FIG. 5 shows the checkout device wherein the settlement section 20 is set at the first position PST1. The first position PST1 is a reference position at which the settlement section is substantially aligned with the stationary scanners 15 forming central portions of the scanning lanes 10A and 10B, and used for permitting one cashier CHR to operate the cash registers 20A and 20B and two customers CST-A and CST-B to operate the stationary scanners 15. In a state where the settlement section 20 is set at the first position PST1, the cashier CHR can be located at a position where each of the stationary scanners 15 of the scanning lanes 10A and 10B comes within her sight (Θ=45 degrees).

Figure 6:
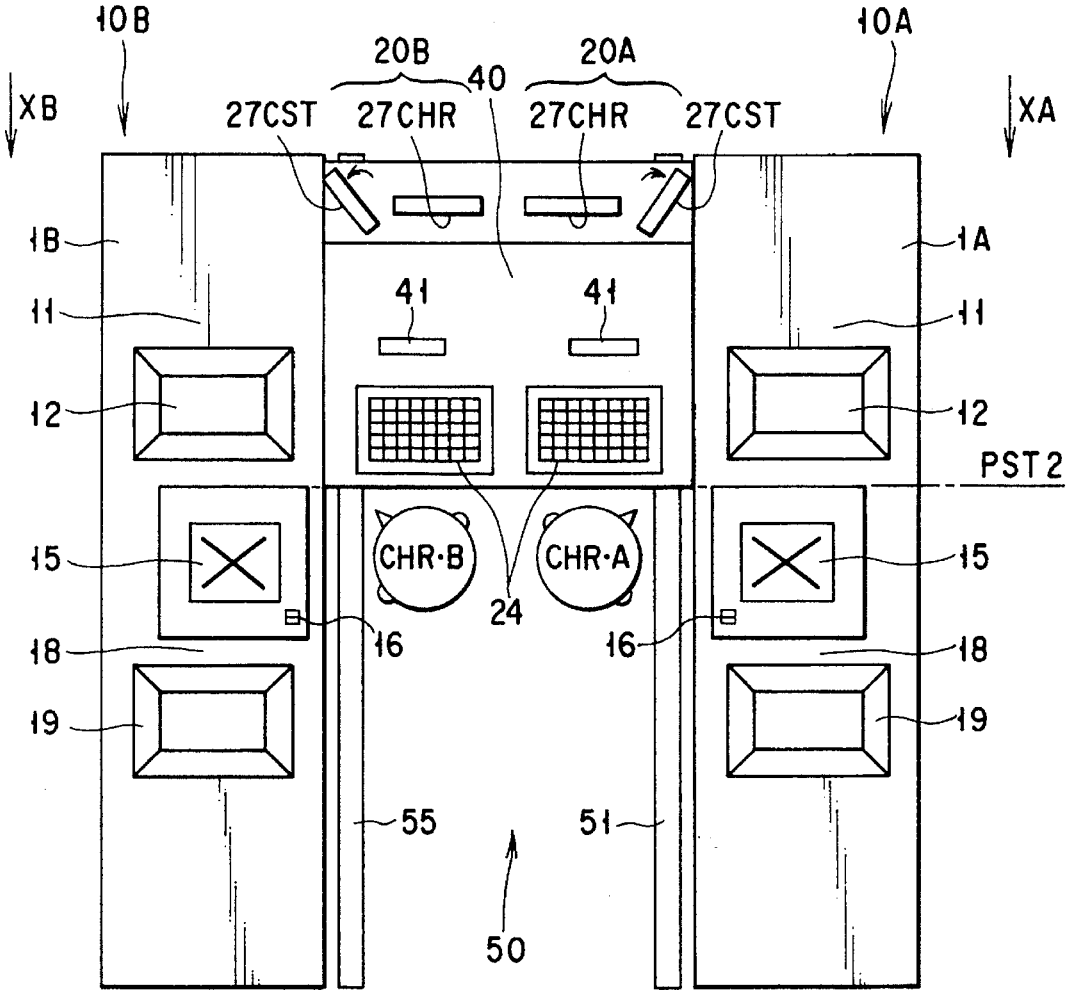
FIG. 6 is a plan view showing the checkout device wherein the settlement section is set at a second position shown in FIG. 4.

FIG. 6 shows the checkout device wherein the settlement section is set at the second position PST2. The second position PST2 is a position which is on the upstream side of the reference position PST1, and used for permitting two cashiers CHR-A and CHR-B to operate the stationary scanners 15 of the scanning lanes 10A and 10B and the cash registers 20A and 20B. In a state where the settlement section is set at the second position PST2, the cashiers CHR-A and CHR-B can be located in front of the settlement section 20 between the stationary scanners 15 of the scanning lanes 10A and 10B.

Figure 7:
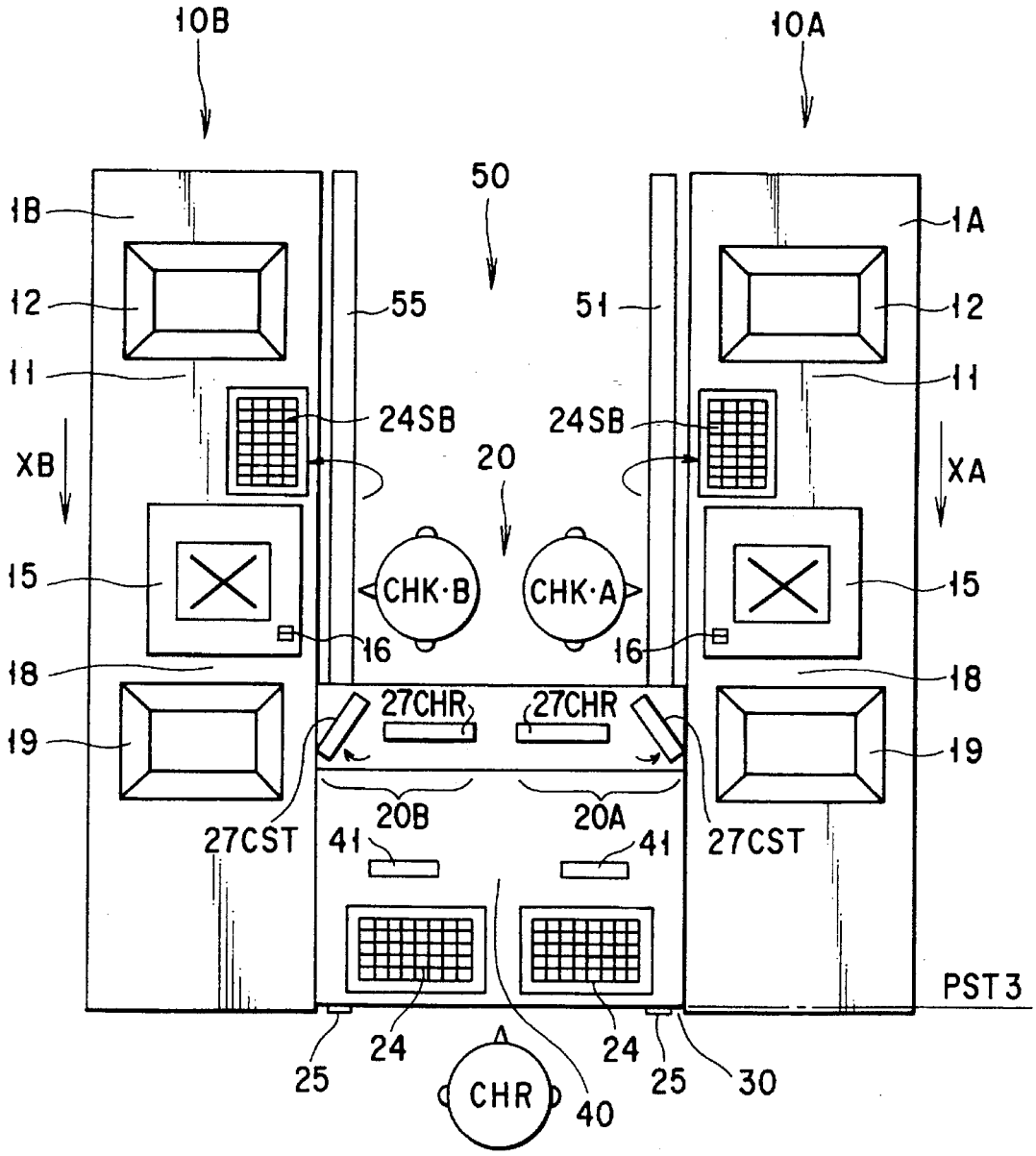
FIG. 7 is a plan view showing the checkout device wherein the settlement section is set at a third section shown in FIG. 4.

FIG. 7 shows the checkout device wherein the settlement section is set at the third position PST3. The third position PST3 is a position which is on the downstream side of the reference position PST1, and used for permitting two cashiers CHK-A and CHK-B to operate the stationary scanners 15 of the scanning lanes 10A and 10B and another cashier CHR to operate the cash registers 20A and 20B. In a state where the settlement section is set at the third position PST3, the cashiers CHK-A and CHK-B can be located behind the settlement section 20 between the stationary scanners 15 of the scanning lanes 10A and 10B and the cashier CHR can be located in front of the settlement section 20. In this state, the cash registers 20A and 20B are connected to sub-keyboards 24SB via a stretchy cable (not shown). Each sub-keyboard 24SB includes a plurality of PLU keys for selecting articles such as articles for special sale and vegetables and numerals keys for inputting article codes of various articles, and, as shown in FIG. 7,used on the carry-in tables 11 by the cashiers CHK-A and CHK-B. If the settlement section 20 is set at the position PST1 or PST2, these sub-keyboards are not used and put on shelves formed inside the sacker table 1A and 1B.

Next, an operation of the foregoing checkout device will now be described.

A customer selects one of the scanning lanes 10A and 10B and moves to the selected scanning lane.

When the checkout device is in a state shown in FIG. 5, the customer CST-A places on the carry-in table 11 the basket 12 containing articles to be purchased in the scanning lane 10A, and depresses the scanning start key of the switching section 16 in front of the scanner 15. By this key operation, the control section 21U of the cash register 20A starts the operation of the scanner 15. The customer CST-A takes the articles out of the basket 12 one by one, and inputs their article codes by use of the scanner 15. The customer CST-A then puts the articles into another empty basket 19 placed on the carry-out table 18. The control section 21U of the cash register 20A sequentially registers article data corresponding to each of the article codes supplied from the scanner 15 as sales data and causes the registered sales data to be displayed on the cashier display unit 27CHR and customer display unit 27CST. After the basket 12 becomes empty, the customer CST-A depresses the end key of the switching section 16. By this key operation, the control section 21U of the cash register 20A stops the operation of the scanner 15. The cashier CHR then depresses the Tendered/Amount Total key provided for execution of the account totalization. The control section 21U thus totalizes all of the registered sales data items, causes the printer 26 to print a receipt indicating the result of totalization containing article names, unit prices, the number of articles, and the total amount, and causes the cashier display unit 27CHR and customer display unit 27CST to display the total amount, and opens the drawer 28. The cashier CHR hands the receipt printed by the printer 26 and issued via the receipt issuing port 41 to the customer CST-A and puts cash paid by the customer CST-A into the drawer 28. The customer CST-A thus completes the checkout, puts all of the articles received in the basket 19 into a shopping bag in a preset place, and then carries the bag.

On the other hand, the customer CST-B performs an operation for inputting article codes by using the scanner 15 on the scanning lane 10B side in the same manner as in the case of the customer CST-A. The cash register 20B performs the same settlement process as that performed by the cash register 20A according to the article codes supplied from the scanner 15 on the scanning lane 10B side. Further, the cashier CHR operates the cash register 20B for the customer CST-B as she does the cash register 20A.

The settlement section 20 performs the settlement processes for the customers CST-A and CST-B in parallel by use of the cash registers 20A and 20B.

Now, assume a case where the articles to be purchased by the customer CST-A include an article such as a bargain or vegetables to which no article code in the bar code form is attached or an article whose article code in the bar code form is stained. Since it is hard for the stationary scanner 15 to read the article code from the above article, the cashier CHR must input the article code of the article. The customer CST-A then places on the article table 40 the article whose article code is difficult to read using the stationary scanner 15. The cashier CHR inputs the article code of the article placed on the article table 40 by means of the keyboard 24 or handy scanner 25 and returns the article to the customer CST-A. The customer CST-A is able to confirm sales data of an article corresponding to the article code input by the cashier CHR by observing the contents displayed on the customer display unit 27CST.

When the checkout device is in a state shown in FIG. 6, the customer places on the carry-in table 11 the basket 12 containing articles to be purchased in the scanning lane 10A. At this time, the cashier CHR-A depresses the scanning start key of the switching section 16 in front of the scanner 15. By this key operation, the control section 21U of the cash register 20A starts the operation of the scanner 15. The cashier CHR-A takes the articles out of the basket 12 one by one, and inputs their article codes by use of the scanner 15. The cashier CHR-A then puts the articles into another empty basket 19 placed on the carry-out table 18. The control section 21U of the cash register 20A sequentially registers article data corresponding to each of the article codes supplied from the scanner 15 as sales data and causes the registered sales data to be displayed on the cashier display unit 27CHR and customer display unit 27CST. After the basket 12 becomes empty, the cashier CHR-A depresses the end key of the switching section 16. By this key operation, the control section 21U of the cash register 20A stops the operation of the scanner 15. The cashier CHR-A then depresses the Tendered/Amount Total key provided for execution of the account totalization. The control section 21U thus totalizes all of the registered sales data items, causes the printer 26 to print a receipt indicating the result of totalization containing article names, unit prices, the number of articles, and the total amount, and causes the cashier display unit 27CHR and customer display unit 27CST to display the total amount, and opens the drawer 28. The cashier CHR-A hands the receipt printed by the printer 26 and issued via the receipt issuing port 41 to the customer and puts cash paid by the customer into the drawer 28. The customer thus completes the checkout, puts all of the articles received in the basket 19 into a shopping bag in a preset place, and then carries the bag.

On the other hand, the cashier CHR-B performs an operation for inputting article codes by using the scanner 15 on the scanning lane 10B side in the same manner as in the case of the cashier CHR-A. The cash register 20B performs the same settlement process as that performed by the cash register 20A according to the article codes supplied from the scanner 15 on the scanning lane 10B side. Further, the cashier CHR-B operates the cash register 20B for another customer as the cashier CHR-A does the cash register 20A.

The settlement section 20 performs the settlement processes for the customers in parallel by use of the cash registers 20A and 20B.

Now, assume a case where the articles to be purchased by the customer include an article such as a bargain or vegetables to which no article code in the bar code form is attached or an article whose article code in the bar code form is stained. The cashier CHR-A (CHR-B) inputs the article code of the article by means of the keyboard 24 or handy scanner 25 and puts the article into the basket 19. The customer is able to confirm sales data of an article corresponding to the article code input by the cashier CHR-A (CHR-B) by observing the contents displayed on the customer display unit 27CST.

When the checkout device is in a state shown in FIG. 7, the customer places on the carry-in table 11 the basket 12 containing articles to be purchased in the scanning lane 10A. At this time, the cashier CHK-A depresses the scanning start key of the switching section 16 in front of the scanner 15. By this key operation, the control section 21U of the cash register 20A starts the operation of the scanner 15. The cashier CHK-A takes the articles out of the basket 12 one by one, and inputs their article codes by use of the scanner 15. The cashier CHK-A then puts the articles into another empty basket 19 placed on the carry-out table 18. The control section 21U of the cash register 20A sequentially registers article data corresponding to each of the article codes supplied from the scanner 15 as sales data and causes the registered sales data to be displayed on the cashier display unit 27CHR and customer display unit 27CST. After the basket 12 becomes empty, the cashier CHK-A depresses the end key of the switching section 16. By this key operation, the control section 21U of the cash register 20A stops the operation of the scanner 15. The cashier CHR then depresses the Tendered/Amount Total key provided for execution of the account totalization. The control section 21U thus totalizes all of the registered sales data items, causes the printer 26 to print a receipt indicating the result of totalization containing article names, unit prices, the number of articles, and the total amount, and causes the cashier display unit 27CHR and customer display unit 27CST to display the total amount, and opens the drawer 28. The cashier CHR hands the receipt printed by the printer 26 and issued via the receipt issuing port 41 to the customer and puts cash paid by the customer into the drawer 28. The customer thus completes the checkout, puts all of the articles received in the basket 19 into a shopping bag in a preset place, and then carries the bag.

On the other hand, the cashier CHK-B performs an operation for inputting article codes by using the scanner 15 on the scanning lane 10B side in the same manner as in the case of the cashier CHK-A. The cash register 20B performs the same settlement process as that performed by the cash register 20A according to the article codes supplied from the scanner 15 on the scanning lane 10B side. Further, the cashier CHR operates the cash register 20B for another customer as she does the cash register 20A.

The settlement section 20 performs the settlement processes for the customers in parallel by use of the cash registers 20A and 20B.

Now, assume a case where the articles to be purchased by the customer include an article such as a bargain or vegetables to which no article code in the bar code form is attached or an article whose article code in the bar code form is stained. The cashier CHK-A (CHK-B) inputs the article code of the article by means of the sub-keyboard 24SB and puts the article into the basket 19. The customer is able to confirm sales data of an article corresponding to the article code input by the cashier CHK-A (CHK-B) by observing the contents displayed on the customer display unit 27CST.

In the checkout device of this embodiment, the position adjusting mechanism 50 variably sets a position of the settlement section 20 along the first and second scanning lanes 10A and 10B. Therefore, the position of the settlement section 20 can be changed without taking much labor. In a case where the settlement section is set at a reference position PST1 where it is aligned with the first and second stationary scanners 15, one operator stands in front of the settlement section 20 to operate it. In this case, the operator is able to monitor each of two customers who operate the first and second stationary scanners 15 to input article codes. In a case where the settlement section 20 is set on the upstream side of the reference position PST1, two operators stand in front of the settlement section 20 between the first and second stationary scanners 15 to operate the settlement section 20 and the first and second scanners 15. In this case, article codes are input by the two operators, it is possible to eliminate a delay caused when article codes are input by a customer who is not familiar with the checkout device. In a case where the settlement section 20 is set on the down stream side of the reference position PST1, two operators stand behind the settlement section 20 between the first and second stationary scanners 15 to operate first and second stationary scanners 15 and another operator stands in front of the settlement section 20 to operate the settlement section 20. In this case, the stationary scanners 15 and settlement section 20 are operated by different operators. Therefore, the checkout speed can be enhanced. Consequently, in the aforementioned checkout device, layout of operators can be optimized by varying the position of the settlement according to change in the number of customers waiting their turn for checkout. Therefore, quick and smooth checkout is not impaired due to an increase in the number of customers. Further, the checkout device can cope with an increase in the number of customers within a limited space. In addition, since the number of operators can be increased in proportion to the number of customers, mental and physical burdens to the operators can be prevented from excessively increasing.

Moreover, the article table 40 is prepared to permit an article whose article code is hard to read by the stationary scanner 15 to be placed thereon. When the customer encounters such an article during the article code input operation, the cashier cannot immediately receive the article in some cases if the cashier is arranging the cash or checking the amount of money or she is dealing with another customer, for example. If, in such a case, the article is placed on the article table 40, its article code is input when the cashier becomes free. Therefore, the customer can resume the article code input operation immediately after the article whose article code is difficult to read by the stationary scanner 15 is placed on the article table 40. That is, the amount of time the article code input operation is interrupted can be shortened. On the other hand, since the article is not directly handed to the cashier CHR from the customer, the cashier is not forced to interrupt another operation which she is effecting.

The present invention is not limited to the above embodiment and can be variously modified without departing from the scope of the subject matter thereof.

The carry-in table 11 and carry-out table 18 shown in FIG. 2 can be replaced with a pushcart storage space or a belt conveyor.

Figure 8:
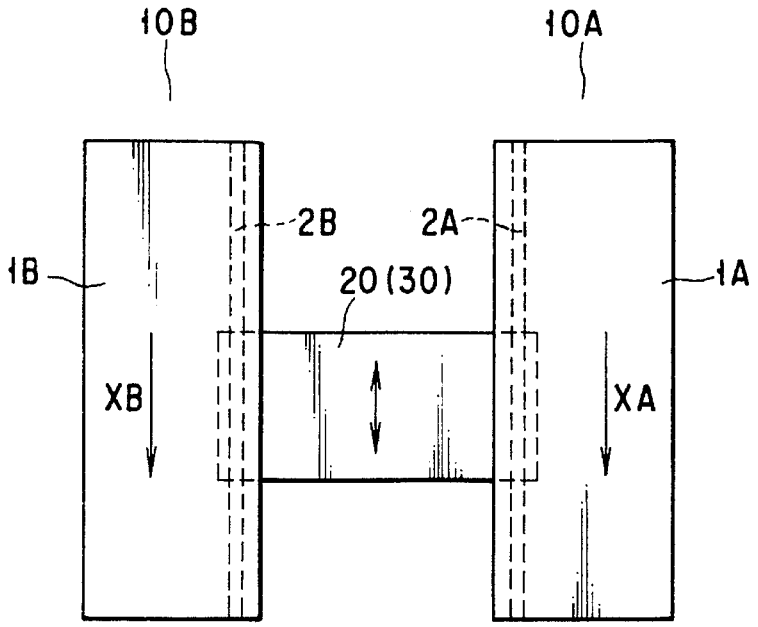
FIG. 8 is a plan view showing a modification of the position adjusting mechanism shown in FIG. 3.

The position adjusting mechanism 50 shown in FIG. 3 can be modified as shown in FIG. 8. In this modification, the rails 51 and 55 are replaced with guide bars 2A and 2B fixed to the sacker tables 1A and 1B in parallel. The housing 30 of the settlement section 20 is bridged over the guide bars 2A and 2B, and slid along these bars 2A and 2B. In this case, the guide bars 2A and 2B can reinforce the sacker tables 1A and 1B with supporting the housing 30. Further, it is possible to additionally provide in the modification a drive motor for automatically moving the settlement section 20 and a position sensor for detecting which one of the positions PST1, PST2, and PST3 the settlement section 20 is located at.

Figure 9:
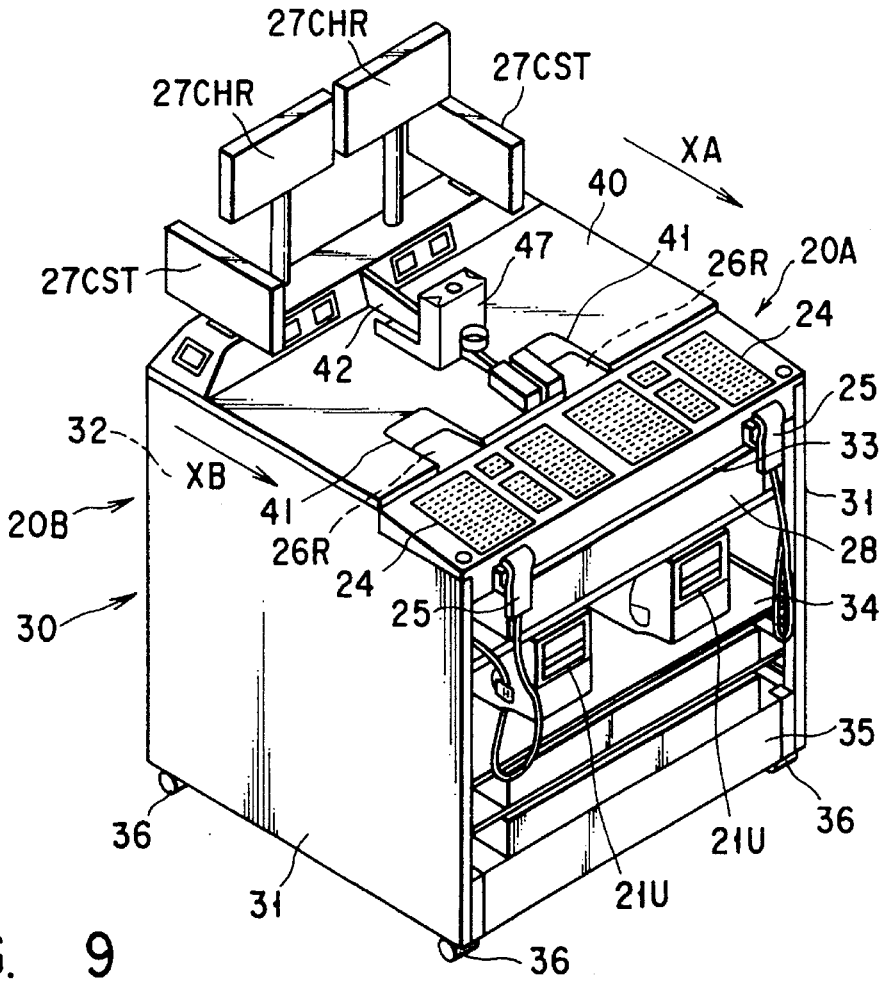
FIG. 9 is a perspective view showing a modification of the settlement section shown in FIG. 3.
Figure 10:
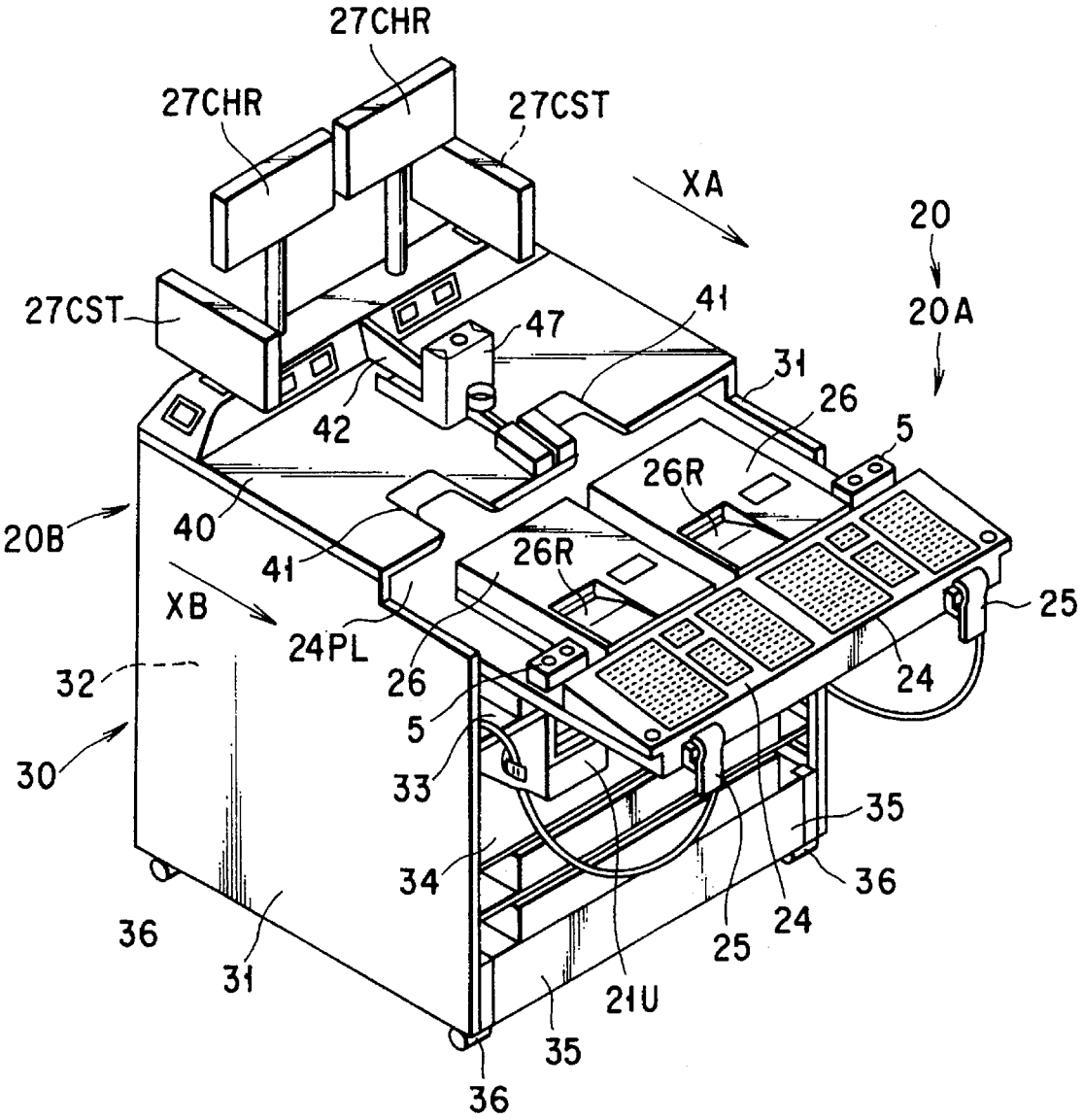
FIG. 10 is a perspective view showing a structure for exposing a printer provided inside the settlement section shown in FIG. 9 for maintenance.

The settlement section shown in FIG. 2 can be modified as shown in FIGS. 9 and 10. The settlement section of the modification includes electronic cash registers 20A and 20B which are respectively assigned to the scanning lanes 10A and 10B, a housing 30 for unifying the cash registers 20A and 20B, and a drawer 28 common to the electronic cash registers 20A and 20B. Each of the electronic cash registers 20A and 20B includes a control section 21U, keyboard 24, handy scanner 25, printer 26, cashier display unit 27CHR, customer display unit 27CST, mode switch 5, receipt issuing port 41, and article table 40. The housing 30 is constructed by right and left side plates 31, back plate 32, slide plate 24PL, slide guide plate 33, a plurality of support plates 34, base 35, four casters 36, and partition wall 42. The slide guide plate 33 and support plates 34 are fixed to the right and left side plates 31 and back plate 32. The right and left side plates 31 and back plate 32 are fixed to the base 35. The four casters 36 are mounted on the corners of the bottom portion of the base 35 so as to permit the settlement section 20 to be carried along the scanning lanes 10A and 10B. The position of the settlement section 20 is fixed by the braking mechanisms of the casters 36. The slide plate 24PL is put on the slide guide plate 33 so as to be drawn from the housing 30 towards the cashier CHR. The components of the electronic cash registers 20A and 20B are symmetrically arranged as shown in FIG. 9.

In each of the electronic cash registers 20A and 20B, the control section 21U is mounted on the support plate 34. The control section 21U includes a CPU, ROM and RAM, and performs various mode processes including a settlement process for sequentially registering items of article data (article names, unit prices, and the like) corresponding to article codes sequentially supplied from the stationary scanner 15 on the side of the corresponding scanning lane 10A (10B) as sales data items and totalizing all of the registered sales data items. The keyboard 24 is fixed to the slide plate 24PL so as to be exposed at the top of the housing 30 and is operated by the cashier CHR to input article codes and control instructions necessary for the settlement process. The keyboard 24 includes a Tendered/Amount Total key for instructing execution of the account totalization, a plurality of PLU keys for selecting articles such as articles for special sale and vegetables and numerals keys for inputting article codes of various articles. The handy scanner 25 is set on the end portion of the keyboard 24 on the cashier CHR side and is operated by the cashier CHR to selectively read one of the article codes printed on a bar code table sheet in the bar code form for articles such as vegetables and articles for special sale. The printer 26 is fixed to the slide plate 24PL and is used to print the result of totalization obtained for all of the registered sales data items on receipt paper. The cashier display unit 27CHR and customer display unit 27CST are exposed at the top of the housing 30 and are respectively set to face the positions of the cashier CHR and the customer CST-A (CST-B) and display each of the registered sales data items. The mode switch 5 is fixed to the slide plate 24PL near the keyboard 24 to select a process mode of the control section 21U according to the position of the inserted key. The article table 40 is exposed in a portion between the display units 27CHR, 27CST and the keyboard 24, constructs a lid plate of the housing 30, and is used to temporarily hold an article whose article code is difficult to read by use of the scanner 15 on the corresponding scanning lane 10A (10B) side. The article table 40 is set at substantially the same height as the scanner 15.

The partition wall 42 is disposed on the boundary portion between the article table of the cash register 20A and the article table of the cash register 20B. The drawer 28 is mounted on the support plate 34 and is caused to slide towards the cashier CHR side by the control of each of the control sections 21U of the cash registers 20A and 20B so as to be set into an open state and receive cash which the cashier puts into the drawer.

The slide 24PL is normally set such that the end portion of the keyboard 24 will be set in contact with the end portion of the article table 40. In this condition, the printer 26 and mode switch 5 are disposed below the article table 40 and received in the housing 30. At the time of maintenance of the printer 26, for example, at the time of supply of receipt paper to the printer 26, the slide plate 24PL is drawn as shown in FIG. 5 and the end portion of the keyboard 24 is set in position apart from the end portion of the article table 40. As a result, the printer 26 and mode switch 5 are exposed from the housing 30 (each cash register can be used irrespective of the position of the slide plate 42). The receipt issuing port 41 is an opening formed in part of the article table 40 and permits a receipt supplied from a receipt discharging port 26R of the printer 26 to pass therethrough when the printer 26 is set in the housing 30 and guides the receipt to the cashier CHR side.

According to the modification, the printer 26 can be exposed simply by drawing the slide plate 24PL towards the cashier CHR. Therefore, the cashier CHR is able to easily and rapidly maintain the printer 26, for example, to supply receipt paper.

The mode switch 5 is usually fixed to the slide plate 24PL received in the housing 30. It is thus possible to prevent the cashier CHR from operating the mode switch 5 erroneously or another person from operating the same without permission.

In the above modification, it is possible to mount wheels on the bottom surface of the slide plate 24PL and rails on the upper surface of the slide guide plate 33, and vice versa. In this case, the slide plate 24PL can be slid more smoothly than in the case where the slide plate 24PL is directly placed on the slide guide plate 33.

It is preferable that the printer 26 is entirely covered with the article table 40 since more articles can be placed on the table 40. However, the article table can be so designed that its part is exposed from the table 40.

What is claimed is:

1. A checkout device comprising:

first and second stationary scanners forming central portions of first and second scanning lanes set in parallel with each other, each for reading an article code affixed to an article which is moved from an upstream side to a downstream side in a corresponding scanning lane;

a settlement section arranged between said first and second scanning lanes for performing a settlement process based on article codes sequentially supplied from each of said stationary scanners; and position adjusting means for variably setting a position of said settlement section along the first and second scanning lanes between the upstream and downstream sides of said scanning lanes.

2. A checkout device according to claim 1, wherein said position adjusting means includes a plurality of rails set in parallel with each other between said first and second scanning lanes and a plurality of casters fixed to a bottom of said settlement section and movable along said rails.

3. A checkout device according to claim 2, wherein said said plurality of rails have a plurality of recesses for receiving said plurality of casters to set the position of said settlement section.

4. A checkout device according to claim 3, wherein said plurality of recesses provide for at least three positions of the settlement section, a first position being for setting said settlement section at a reference position where the settlement section is aligned with said first and second stationary scanners, a second position being for setting said settlement section on an upstream side of the reference position, and a third position being for setting said settlement section on a downstream side of the reference position.

5. A checkout device according to claim 1, wherein said position adjusting means includes means for setting said settlement section at a reference position where the settlement section is substantially aligned with said first and second stationary scanners.

6. A checkout device according to claim 5, wherein said position adjusting means includes means for setting said settlement section on a downstream side of the reference position.

7. A checkout device according to claim 5, wherein said position adjusting means includes means for setting said settlement section on an upstream side of the reference position.

8. A checkout device according to claim 7, wherein said position adjusting means includes means for setting said settlement section on a downstream side of the reference position.

9. A checkout device according to claim 1, wherein said position adjusting means includes means for setting said settlement section at a reference position for permitting one operator to stand at a downstream side of said settlement section.

10. A checkout device according to claim 9, wherein said position adjusting means includes means for setting said settlement section at a downstream position, different from said reference position, for permitting two operators to stand at an upstream side of said settlement section between said first and second stationary scanners and another operator to stand at the downstream side of said settlement section.

11. A checkout device according to claim 9, wherein said position adjusting means includes means for setting said settlement section at an upstream position, different from said reference position, for permitting two operators to stand at the downstream side of said settlement section between said first and second stationary scanners.

12. A checkout device according to claim 11, wherein said position adjusting means includes means for setting said settlement section at a downstream position, different from said reference position, for permitting two operators to stand at an upstream side of said settlement section between said first and second stationary scanners and another operator to stand at the downstream side of said settlement section.

* * * * *